United States Patent [19]

Weinstein et al.

[11] Patent Number: 4,486,195

[45] Date of Patent: Dec. 4, 1984

[54] LAUNDERING COMPOSITIONS

[75] Inventors: Morris Weinstein, Paramus; Lorraine Lillis, Jersey City, both of N.J.

[73] Assignee: Millmaster Onyx Group Inc., New York, N.Y.

[21] Appl. No.: 586,002

[22] Filed: Mar. 5, 1984

[51] Int. Cl.[3] ..... D06M 13/20; D06M 13/40

[52] U.S. Cl. ..... 8/137; 252/8.8

[58] Field of Search ..... 252/8.8; 8/137

[56] References Cited

U.S. PATENT DOCUMENTS

| | | | |
|---|---|---|---|
| 3,826,682 | 7/1974 | Liebowitz et al. | 252/8.8 |
| 3,984,335 | 10/1976 | Ciko et al. | 252/8.8 |
| 4,067,816 | 1/1978 | Evans et al. | 252/8.8 |
| 4,360,437 | 11/1982 | Wolfes | 252/8.8 |
| 4,426,304 | 1/1984 | Ciko et al. | 252/547 |

*Primary Examiner*—Maria Parrish Tungol

*Attorney, Agent, or Firm*—Arthur A. Jacobs

[57] ABSTRACT

Laundering compositions for cleaning and softening fabrics in either cold or hot water comprising a mixture of effective amounts of a fatty acid amidopropyl dimethylamine and a fatty acid amidopropyl betaine.

24 Claims, No Drawings

LAUNDERING COMPOSITIONS

This invention relates to laundering compositions, and it more particularly relates to laundering compositions which can clean and soften fabrics in the same laundering operation, either in cold or hot water.

It is well known that many anionic textile detergents, such as the alkyl sulfates and alkylpolyoxethyl sulfates, are suitable for use in either cold or hot water for hand laundering. It is also well known that many water-soluble cationic quaternary ammonium compounds, particularly the higher alkyl trimethylammonium salts and the di-higher alkyl dimethylammonium salts, are good textile softeners in either cold or hot water.

It would appear that a mixture of such anionic and cationic surfactants would be a useful laundering combination which would cleanse and soften textiles in a single operation in either cold or hot water. However, such combination would not produce such results because, as is well known, most anionic surfactants in aqueous solution are incompatible with most water-soluble cationic quaternary ammonium salts because they form water-insoluble compounds, thereby causing both the cleansing and softening properties to vanish or become grossly attenuated.

Therefore, most commercial laundry detergents focus on performing one job or the other, i.e. either cleaning the fabrics or softening them after they are cleaned.

In accordance with the present invention, it has now been discovered that a mixture of a fatty amidopropyl dimethylamine and a fatty acid amidopropyl betaine is a very good fabric softener and appears to be at least as effective in this respect as the higher alkyl trimethylammonium quaternary salts or the di-higher alkyl dimethylammonium quaternary salts heretofore used. However, unlike these quaternary ammonium salts, the mixture is compatible with most of the anionic surfactants presently used for textile cleaning and does not form insoluble precipitates with them. Therefore, the mixture of amidoamine and amidobetaine, when combined with anionic detergents, makes a very good detergent and fabric softener in either cold water or hot water.

In addition, in accordance with the present invention, it has been discovered that when an amine oxide is added to the combination of amidopropylamine, amidopropyl betaine and anionic surfactant, the efficacy of the ternary mixture, both as to cleansing and softening, is enhanced.

Compositions embodying the present invention may be considered to contain essentially the following components:

1. An amidopropyl dimethylamine having the molecular formula $$\overset{O}{\overset{\|}{R}}CNHCH_2CH_2CH_2-N(CH_3)_2 \text{ where } \overset{O}{\overset{\|}{R}}C-$$

represents the acyl radical $$n\text{-}C_{17}H_{35}\overset{O}{\overset{\|}{C}}$$

derived from stearic acid. This compound, which is stearoylamidopropyl dimethylamine, has an effectiveness that is not reduced when the stearoyl group in the molecular formula is replaced by a mixture of all the acyl groups derived from the fatty acids found in tallow, the resulting product being tallowyl amidopropyl dimethylamine.

2. An amidopropyl betaine having the molecular formula $$\overset{O}{\overset{\|}{R'}}CNHCH_2CH_2CH_2N^+(CH_3)_2CH_2\overset{O}{\overset{\|}{C}}-O^-, \text{ where } \overset{O}{\overset{\|}{R'C}}-$$

represents the acyl group derived from lauric acid. This compound, which is lauroylamidopropyl betaine, has an effectiveness that is not reduced when the lauroyl group $$\overset{O}{\overset{\|}{(R'C)}}$$

in the molecular formula is replaced by a mixture of all the acyl groups derived from the fatty acids found in coconut oil, the resulting product being cocoylamidopropyl betaine.

3. An alkyl polyoxyethyl sulfate anionic surfactant of molecular formula $R''\ (OCH_2CH_2)m\ OSO^-{}_3M^+$, where R'' represents the alkyl group $n—C_{12}H_{25}$,m represents an integer between about 1 to 5 with an average of about 3, $M^+$ represents the cation of Group I metal or the ammonium ion or a substituted ammonium ion such as a triethanolammonium cation.

Since the alkyl group $n—C_{12}H_{25}—$ is derived from lauric acid, the preferred anion is the lauryl tri(oxyethyl)sulfate anion, the effectiveness of which is not reduced when the lauryl group (R'') in the molecular formula is replaced by a mixture of all of the alkyl groups derived from the fatty acids found in coconut oil; the resulting product being coco alkyl tri(oxyethyl)-sulfate.

It has been found that the lauryl sulfate anion and the coco alkyl sulfate anions are compatible with mixtures of amidopropyl amines and amidopropyl betaine as described above. Furthermore, these blends containing the non-oxyethylated alkyl sulfates are just as effective as those containing the oxyethylated alkyl sulfates. Therefore, the formula above may also represent anions in which m=o.

4. An alkyl amine oxide having the molecular formula:

$$R''-\overset{CH_3}{\underset{CH_3}{N}}-O$$

wherein R'' represents either the lauryl alkyl group or a mixture of all of the alkyl groups derived from all of the fatty acids found in coconut oil.

A mixture of the above four components appears to be most effective as a softener when the components are present in a proportion by weight of amidopropyl dimethylamine: amidopropyl betaine: anionic surfactant: amine oxide=1:1:1:0.4 wherein each and every component in the mixture may vary in relative amount by as much as 33%.

The combination of components is most effective when the aqueous solution is acidic, i.e. at pH of about 6. However, the aqueous solution must not be too acidic lest the high acidity inactivate anionic surfactants which may be present.

Several aqueous mixtures of the above four components were made up to contain 100 times the preferred laundering concentration so that laundering tests could be carried out by diluting the concentrated solutions 1:100. The concentrated solutions were acidified to a pH of 5.8 to 6.2 with 85% phosphoric acid. When an aliquot was diluted to 100 times its volume, the pH remained unchanged at 5.8 to 6.2. These dilute solutions were used for testing the softening effects of this invention on textiles.

Using an aqueous solution that contains the mixture of this invention at a concentration of about 0.25%, it was found that the fabric softening ability did not become discernible until the quantity of the mixture in the wash water reached about 1.6% of the weight of fabric being laundered. However, the optimum effect was achieved when the mixture was present in the wash water to the extent of about 2.4%, based on the weight of the cloth.

The ratio, by weight, of wash water to fabric that was tested varied from about 8:1 to about 16:1.

When the ratio of wash water to fabric is 8:1 by weight, the water should contain the mixture of this invention at a concentration of about 0.3%.

When the ratio of water to fabric is 10:1 by weight, the water should contain the mixture of this invention at a concentration of about 0.25%.

When the ratio of water to fabric is 12:1 by weight, the water should contain the mixture of this invention at a concentration of about 0.2%.

When the ratio of water to fabric is 16:1 by weight, the concentration of the mixture of this invention in the water should be about 0.15%.

The following procedure was used for ascertaining the properties of the products of the present invention:

Step 1. Concentrated aqueous solutions of the compositions were prepared, of which the following Example is illustrative:

EXAMPLE

| | Parts Weight | Parts Pure Solids |
|---|---|---|
| stearoylamidopropyl dimethylamine (pure) | 7.0 | 7.0 |
| cocoamidopropyl betaine (35% solution) | 25.0 | 8.75 |
| sodium lauryl tri (oxyethyl) sulfate (30% solution) | 25.0 | 7.5 |
| lauryl dimethylamine oxide (30% solution) | 10.0 | 3.0 |
| water | 33.0 | |
| | 100.0 | 26.25 |

Phosphoric acid (85% concentration) was added dropwise to the above solution until it reached a pH of 6.

Step 2. A large portion of the concentrated solution of the above example was diluted 1:100 in water so that the diluted solution contained 0.2625% active solids, of which stearoylamidopropyl dimethylamine constituted 0.07%, cocoylamidopropyl betaine constituted 0.0875%, sodium lauryl tri(oxyethyl)sulfate constituted 0.075%, and lauryl dimethylamine oxide constituted 0.03%. The pH of the diluted solution was 6.

Step 3. Six square swatches of untreated cotton fabric, 6"×6" were weighed. (In one particular experiment they weighed a total of 18.2 grams). The six swatches were soaked for exactly 3 minutes in 10 times their weight of the dilute solution made in Step 2. (In the particular experiment the solution weighed 182 grams). The six swatches of fabric were then rinsed under cold running tap water for exactly 3 minutes. Each swatch was squeezed (without wringing) as dry as possible by hand, and spread out flat to air dry.

Step 4. As controls, separate 1:100 aqueous solutions of the commercial products "Downy" and "Woolite" were prepared. "Downy" was used as a positive control because it contains only fabric softener and is marketed for its fabric softening properties alone. "Woolite" was used as a negative control because it is not marketed as a fabric softener, but for its detergent properties alone. In addition to these two controls, a third neutral control, plain cold water, was also used.

Six untreated cotton 6"×6" square swatches were treated in a manner identical with Step 3 for each one of the three controls.

Step 5. Four piles of square swatches were prepared, each pile containing the six swatches resulting from the respective treatments described above (one with the product of the invention and the other three with the three controls).

A panel of 10 women, each a homemaker and experienced in laundering fabrics at home, was asked to evaluate the softness of each pile of swatches. Each woman was permitted to select and feel as many swatches as she wished from each pile, and to replace each swatch in the pile from which she selected it. Each woman was asked to rate each pile for its softness and feel on a scale from 1 to 5, "1" representing what they thought was a very superior feeling of softness, and "5" representing no soft feel at all.

The test was a double blind test in that the supervisor of the test did not know what formulation (if any) was represented by any pile, the women did not know which pile represented which product, and the person who prepared the piles had no hand in the administration of the test.

Step 6. Steps 3, 4 and 5 were repeated an additional two times, but with the substitution of a respective one of the following fabrics for the cotton in each test: polyester/cotton, 65%/35%; "Orlon" (polyacrylamide fiber).

Step 7. All of the evaluations were compiled into the following table.

TABLE

| | COTTON | | | | COTTON/POLYESTER 35%/65% | | | | ORLON | | | |
|---|---|---|---|---|---|---|---|---|---|---|---|---|
| EVALUATER | Wtr. | "Woolite" | "Downy" | Ex. 1 | Wtr. | "Woolite" | "Downy" | Ex. 1 | Wtr. | "Woolite" | "Downy" | Ex. 1 |
| 1 | 4 | 3 | 1 | 2 | 3 | 5 | 4 | 2 | 3 | 4 | 2 | 1 |
| 2 | 4 | 2 | 3 | 1 | 5 | 3 | 4 | 1 | 3 | 4 | 1 | 2 |
| 3 | 4 | 3 | 1 | 2 | 5 | 3 | 2 | 1 | 4 | 1 | 3 | 2 |
| 4 | 4 | 3 | 2 | 1 | 5 | 3 | 2 | 1 | 4 | 3 | 2 | 1 |
| 5 | 4 | 3 | 2 | 1 | 5 | 4 | 2 | 1 | 3 | 4 | 2 | 1 |
| 6 | 4 | 3 | 2 | 1 | 4 | 5 | 2 | 1 | 4 | 3 | 1 | 2 |

TABLE-continued

| | COTTON | | | | COTTON/POLYESTER 35%/65% | | | | ORLON | | | |
|---|---|---|---|---|---|---|---|---|---|---|---|---|
| EVALUATER | Wtr. | "Woolite" | "Downy" | Ex. 1 | Wtr. | "Woolite" | "Downy" | Ex. 1 | Wtr. | "Woolite" | "Downy" | Ex. 1 |
| 7 | 4 | 2 | 3 | 1 | 4 | 3 | 1 | 2 | 3 | 4 | 1 | 2 |
| 8 | 4 | 2 | 3 | 1 | 5 | 4 | 2 | 1 | 4 | 2 | 3 | 1 |
| 9 | 4 | 3 | 2 | 1 | 5 | 4 | 2 | 1 | 4 | 3 | 2 | 1 |
| 10 | 3 | 4 | 1 | 2 | 3 | 5 | 2 | 1 | 4 | 3 | 2 | 1 |
| Sum | 39 | 28 | 20 | 13 | 44 | 39 | 23 | 12 | 36 | 31 | 19 | 14 |
| Average | 3.9 | 2.8 | 2.0 | 1.3 | 4.4 | 3.9 | 2.3 | 1.2 | 3.6 | 3.1 | 1.9 | 1.4 |

The results of the test for fabric softness illustrates that the present invention imparts a feeling of softness to the fabrics containing cotton, polyester/cotton, and acrylamide fibers, and that its effect in this regard is superior to that of either "Downy" or "Woolite."

Similar tests were conducted using a mixture that did not contain amine oxide, i.e. a wash solution having a pH of 6 and containing 0.07% by weight stearoylamidopropyl dimethylamine, cocoamidopropyl betaine, and 0.075% by weight sodium lauryl tri(oxyethyl)sulfate, the wash solution containing a total of 2.33% by weight of this mixture based on the weight of the fabric.

Even without the amine oxide in the mixture, it was equal to "Downy" in fabric softening effectiveness, but, unlike "Downy", it was compatible with anionics such as sodium lauryl tri(oxyethyl)sulfate, and sodium lauryl sulfate.

The invention claimed is:

1. A fabric treating composition comprising a mixture of an effective amount of a fatty acid amidopropyl dimethylamine and an effective amount of a fatty acid amidopropyl betaine.

2. The composition of claim 1 wherein the amidopropyl dimethylamine is selected from the group consisting of stearoylamidopropyl dimethylamine and tallowyl amidopropyl dimethylamine.

3. The composition of claim 1 wherein the amidopropyl betaine is selected from the group consisting of lauroylamidopropyl betaine and cocoylamidopropyl betaine.

4. The composition of claim 1 wherein the amidopropyl dimethylamine is selected from the group consisting of stearoylamidopropyl dimethylamine and tallowyl amidopropyl dimethylamine and the amidopropyl betaine is selected from the group consisting of lauroylamido-propyl betaine and cocoylamidopropyl betaine.

5. The composition of claim 1 which also includes an effective amount of an anionic surfactant.

6. The composition of claim 5 wherein the anionic surfactant has the formula $R''(OCH_2CH_2)_mOSO_3—M^+$, where R'' is $n—C_{12}H_{25}^-$, and m is an integer of from 0 to about 5 and $M^+$ is a cation of a Group I metal, an ammonium ion or a substituted ammonium ion.

7. The composition of claim 6 wherein the anionic surfactant is selected from the group consisting of lauryl sulfate and cocoalkyl sulfate.

8. The composition of claim 1 which also includes an effective amount of an anionic surfactant and an effective amount of an amine oxide.

9. The composition of claim 8 wherein the amine oxide has the formula:

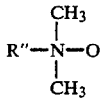

wherein R'' is selected from the group consisting of lauryl and a mixture of all the alkyl groups derived from coconut oil.

10. The composition of claim 8 wherein the components of the composition are present in a proportion by weight of amidopropyl dimethylamine: amidopropyl betaine: anionic surfactant: amine oxide of about 1:1:1:0.4.

11. A method of laundering fabric which comprises immersing the fabric in a wash solution of water and a laundry composition, said composition comprising a mixture of an effective amount of a fatty acid amidopropyl dimethylamine and an effective amount of a fatty acid amidopropyl betaine.

12. The method of claim 11 wherein the amidopropyl dimethylamine is selected from the group consisting of stearoylamidopropyl dimethylamine and tallowyl amidopropyl dimethylamine.

13. The method of claim 11 wherein the amidopropyl betaine is selected from the group consisting of laurylamidopropyl betaine and cocoylamidopropyl betaine.

14. The method of claim 11 wherein the amidopropyl dimethylamine is selected from the group consisting of stearoylamidopropyl dimethylamine and tallowyl amidopropyl dimethylamine and the amidopropyl betaine is selected from the group consisting of lauroylamidopropyl betaine and cocoylamidopropyl betaine.

15. The method of claim 11 wherein said composition also includes an effective amount of an anionic surfactant.

16. The method of claim 11 wherein said composition also includes an anionic surfactant having the formula $R''(OCH_2CH_2)_mOSO_3^-M^+$, where R'' is $n—C_{12}H_{25}^-$, and m is an integer of from 0 to about 5, and $M^+$ is a cation of a Group I metal, an ammonium ion or a substituted ammonium ion.

17. The method of claim 11 wherein said composition also includes an anionic surfactant selected from the group consisting of lauryl tri(oxyethyl)sulfate and cocoalkyl tri(oxyethyl)sulfate.

18. The method of claim 11 wherein said composition also includes an anionic surfactant and an effective amount of amine oxide.

19. The method of claim 18 wherein the amine oxide has the formula:

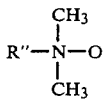

wherein R″ is selected from the group consisting of lauryl and a mixture of all the alkyl groups derived from coconut oil.

20. The method claim 18 wherein the components of the composition are present in a proportion by weight of amidopropyl dimethylamine: amidopropyl betaine: anionic surfactant: amine oxide of about 1:1:1:0.4.

21. The method of claim 18 wherein the quantity of the composition in the wash solution is between about 1.5 to about 3.0% by weight of the weight of the fabric being treated.

22. The method of claim 18 wherein the pH of the wash solution is between about 5.8 to about 6.2.

23. The method of claim 18 wherein the weight of wash solution relative to the weight of the fabric is between about 8:1 and about 16:1.

24. The method of claim 23, wherein the composition is present in the solution in a concentration of between about 0.15% and 0.3% by weight.

* * * * *